United States Patent [19]

Suzuki

[11] 4,430,539

[45] Feb. 7, 1984

[54] HIGH-FREQUENCY HEATING DEVICE

[75] Inventor: Yukio Suzuki, Fuji, Japan

[73] Assignee: Tokyo Shibaura Denki Kabushiki Kaisha, Kawasaki, Japan

[21] Appl. No.: 318,560

[22] Filed: Nov. 5, 1981

[30] Foreign Application Priority Data

Nov. 11, 1980 [JP] Japan ..... 55-161055[U]

[51] Int. Cl.[3] ..... H05B 6/72

[52] U.S. Cl. ..... 219/10.55 F

[58] Field of Search ..... 219/10.55 F, 10.55 E, 219/10.55 R

[56] References Cited

U.S. PATENT DOCUMENTS

| | | | |
|---|---|---|---|
| 2,920,174 | 1/1960 | Haagensen | 219/10.55 F |
| 2,618,735 | 11/1952 | Hall | 219/10.55 |
| 2,748,239 | 5/1956 | Long et al. | 219/10.55 |
| 2,813,185 | 12/1957 | Smith | 219/10.55 |
| 2,831,952 | 4/1958 | Warner | 219/10.55 |
| 2,961,520 | 11/1960 | Long | 219/10.55 |
| 3,172,987 | 3/1965 | Fitzmayer | 219/10.55 |
| 3,436,507 | 4/1969 | Puschner | 219/10.55 |
| 3,443,050 | 5/1969 | Puschner | 219/10.55 |
| 3,471,671 | 5/1969 | Puschner | 219/10.55 |
| 3,532,847 | 5/1969 | Puschner | 219/10.55 |
| 3,746,823 | 7/1973 | Whiteley | 219/10.55 F |
| 4,144,436 | 3/1979 | Hauck | 219/10.55 F |
| 4,176,266 | 11/1979 | Kaneko et al. | 219/10.55 F |
| 4,185,181 | 1/1980 | Kaneko et al. | 219/10.55 F |

FOREIGN PATENT DOCUMENTS

| | | | |
|---|---|---|---|
| 2045589 | 10/1980 | United Kingdom | 219/10.55 F |

*Primary Examiner*—Volodymyr Y. Mayewsky
*Assistant Examiner*—Philip H. Leung
*Attorney, Agent, or Firm*—Cushman, Darby & Cushman

[57] ABSTRACT

A high-frequency heating device comprises a rotating disk including a base plate made of a material having low dielectric loss and arranged above in a heating chamber to rotate around its center axis, and a plurality of high-frequency screening pieces of a fan shape each arranged above the base plate through projections and defining an exciting opening therebetween which has plural portions extending radially from the center axis to the outer circumference of the base plate. The rotating disk is driven by a motor whereby high-frequency energy generated by a magnetron is introduced into the heating chamber through a wave-guide and the exciting opening.

10 Claims, 10 Drawing Figures

HIGH-FREQUENCY HEATING DEVICE

BACKGROUND OF THE INVENTION

The present invention relates to a high-frequency heating device such as microwave oven, for example.

FIG. 1 shows a conventional high-frequency heating device wherein a magnetron (or high-frequency oscillator) 3 is arranged above a heating chamber 2 housed in a body 1 and a turntable 4 is arranged in the heating chamber 2. The turntable 4 rotates in such a way that food 5 or the like mounted on the turntable 4 can be uniformly heated however high-frequency energy emanated from the magnetron 3 may be distributed in the heating chamber 2.

However, with this prior art high-frequency heating device shown in FIG. 1, the circular turntable 4 is arranged in the box-shaped heating chamber 2 so that each corner of heating chamber 2 and its adjacent portion are left unused, thus making it impossible to efficiently use the inside of heating chamber 2. When the space in which food 5 or the like is practically housed and which will be hereinafter referred to as cooking space is kept to have a certain volume, the dimension of whole heating chamber 2 itself becomes bulky, thus making it difficult to make the whole of device small-sized. In addition, the arrangement of mounting food 5 or the like on the turntable 4 needs a large-sized driving motor 6 having comparatively large output to drive the turntable 4. This is another reason why the prior art device could not be improved in cost and size.

FIG. 2 shows another conventional high-frequency heating device wherein a heating chamber 2 and a magnetron (or high-frequency oscillator) 7 are housed in a body 1 and high-frequency energy emanated from the magnetron 7 is introduced into the heating chamber 2 through a waveguide 8 and an exciting opening 8*a* formed in the roof of heating chamber 2 while stirred by a stirrer fan 10 attached to the roof of heating chamber 2 so as to make the distribution of high-frequency energy good in the heating chamber 2. A partition plate 9 is provided for covering the stirrer fan 10 from below and being made of dielectric material having low dielectric loss (tan δ).

With the prior art device shown in FIG. 2, the stirrer fan 10 arranged in the heating chamber 2 makes it necessary to form in the heating chamber 2 a comparatively large space in which the stirrer fan 10 is housed. In addition, the height of partition plate 9 must be made comparatively large. Therefore, when the cooking space in the heating chamber 2 is kept to have a certain volume, the whole of heating chamber 2 can not avoid being made comparatively bulky, which was a problem standing on the way of making the whole of device small-sized.

SUMMARY OF THE INVENTION

The present invention is intended to eliminate these drawbacks and the object of the present invention is therefore to provide a high-frequency heating device capable of keeping the distribution of high-frequency energy introduced into a heating chamber under better condition and making the whole of device smaller-sized.

DETAILED DESCRIPTION OF THE PREFERRED EMBODIMENTS

An embodiment of high-frequency heating device according to the present invention will be described with reference to the accompanying drawings.

Figure 1:
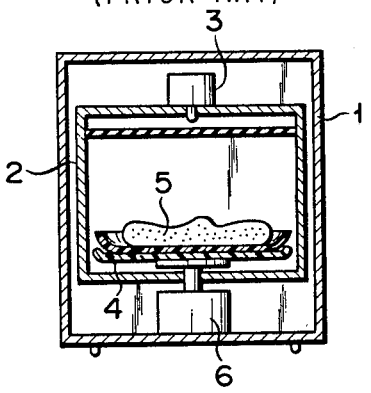
FIG. 1 (PRIOR ART)
FIGS. 1 and 2 are sectional views showing prior art high-frequency heating devices, respectively.
Figure 2:
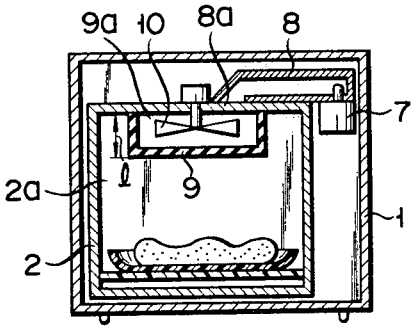
FIG. 2 (PRIOR ART)
Figure 3:
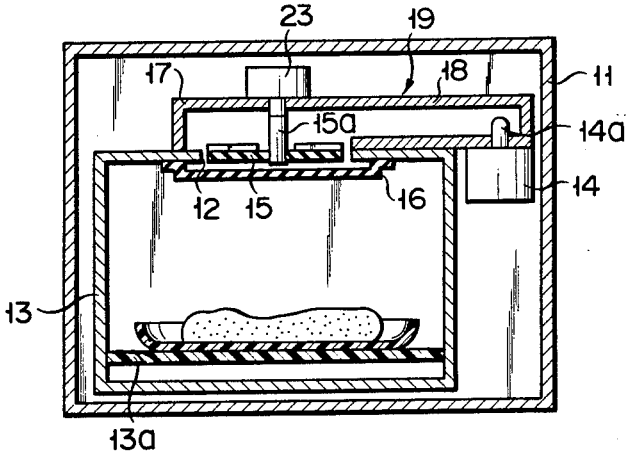
FIGS. 3 and 4 are longitudinally-sectioned and cross-sectioned views showing an embodiment of high-frequency heating device according to the present invention.
Figure 4:
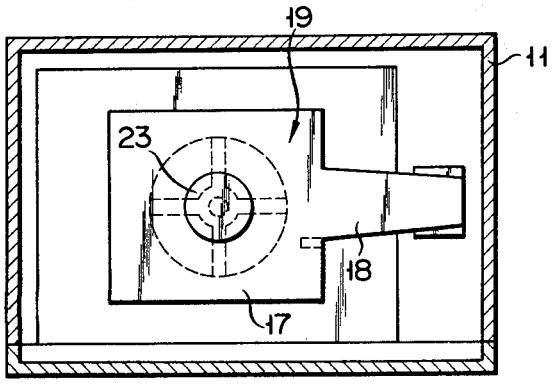
Figure 5:
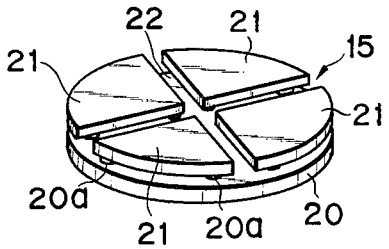
FIGS. 5 to 7 are perspective, plan and cross-sectional views showing a rotating disk employed in the high-frequency heating device.
Figure 6:
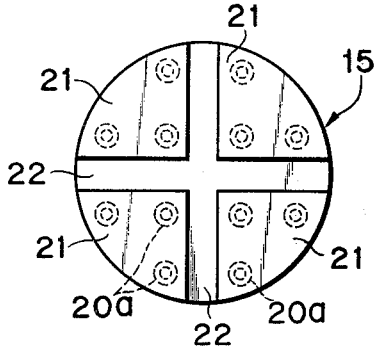
Figure 7:
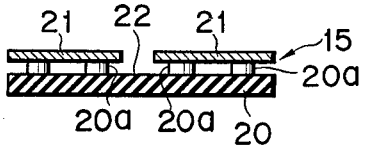

FIGS. 3 and 4 show the schematic arrangement of a high-frequency heating device such as microwave oven, for example, in which numeral 11 represents a box-shaped body. In the body 11 are housed a heating chamber 13 provided with a circular hole (or opening) 12 in the center of roof thereof, and a magnetron (or high-frequency oscillator) 14. A shelf plate 13*a* on which food is mounted is arranged adjacent to the bottom of heating chamber 13. The circular hole 12 formed in the roof of heating chamber 13 is closed by a partition plate 16, which is made of a material having low dielectric loss (tan δ) such as polypropylene plastic and arranged below the circular hole 12 so as to screen a rotating disk 15, which will be described later, from vapor and the like in the heating chamber 13. On the roof of heating chamber 13 is arranged a hollow box 17 so as to close the circular hole 12 from above. This hollow box 17 is associated with a connection part 18, which electromagnetically couples the hollow box 17 with an antenna portion 14*a* of magnetron 14, to form a waveguide 19. In the circular hole 12 is concentrically arranged the rotating disk 15 having a diameter a little smaller than that of circular hole 12. As shown in FIGS. 5 to 7, the rotating disk 15 comprises a circular base plate 20 having a diameter of 180 mm, made of a material having low dielectric loss and high-frequency transmission coefficients, and high-frequency screening pieces 21 which are formed by four pieces of fan-shaped light metal such as aluminum each having a central angle of 90°. These high-frequency screening pieces 21 are arranged above the base plate 20 in such a way that their arched edges are in accord with the outer circumference of base plate 20 and that a cross-shaped exciting opening 22 having a predetermined width, for example 30 mm is formed between their straight-lined edges. The rotating disk 15 has a shaft 15*a* connected to the rotating shaft of a motor 23 which is mounted on the roof of hollow box 17, and is rotated on a horizontal plane taking the shaft 15*a* as its center. The shaft 15*a* is made of low dielectric loss material and may be formed integral with the base plate 20.

The underside of each of screening pieces 21 is spaced by a certain distance, for example 0.5 mm or more from the upper surface of base plate 20 through a plurality of projections 20*a* located therebetween. The projections 20*a* are formed integral to the base plate 20 on some plural portions of base plate 20 and screening pieces 21 are mounted on these projections 20*a*. Therefore, screening pieces 21 are spaced only by the height of projections 20*a* from the base plate 20. These projections 20*a* may be formed separately from the base plate 20 and fixed by some appropriate means between the base plate 20 and screening pieces 21. It is preferable in any cases that the height of projections 20*a* is set over 0.5 mm.

With the high-frequency heating device having such arrangement as described above, high-frequency energy emanated from the magnetron 14 is introduced into the hollow box 17 through the connection part 18. High-frequency energy introduced into the hollow box 17 is almost all reflected by surfaces of screening pieces 21 and thus prevented from entering into the heating chamber 13 through the pieces 21. Therefore, high-frequency energy in the hollow box 17 is almost introduced into the heating chamber 13 through the exciting opening 22. The exciting opening 22 is rotated associating with the rotation of rotating disk 15 so that high-frequency introduced into the heating chamber 13 can be distributed uniformly.

If the rotating disk 15 is formed with the whole underside of each of screening pieces 21 contracted with the upper surface of base plate, since high-frequency is concentrated in this case at corners of each of screening pieces 21, that is, the top of fan and those portions at which its straight sides cross its arched face, these corners are excessively heated to cause the base plate 20 to be heat-deformed. When this heat deformation is caused, the rotating disk 15 may not be rotated uniformly to thereby make temperature distribution uneven in the heating chamber. In the device as described above, the screening piece 21 is apart from the base plate 20 through the projections 20*a*, so that the heat deformation of the base plate 20 may be prevented.

Figure 8:
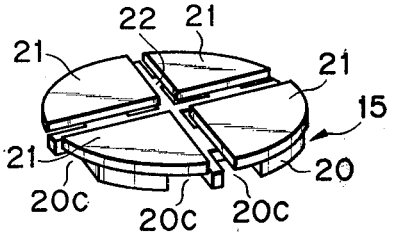
FIGS. 8 through 10 are perspective, plan and cross-sectional views showing a further variation of rotating disk.
Figure 9:
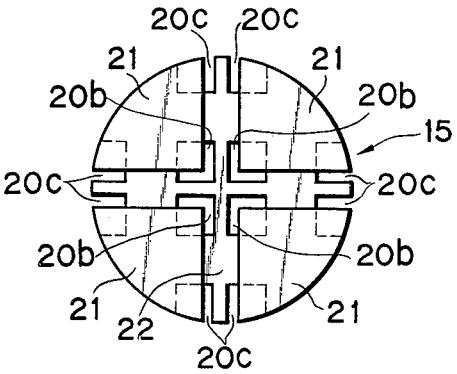
Figure 10:
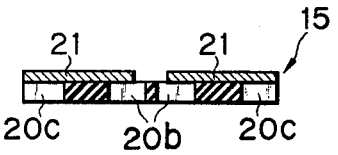

In the case of rotating disk 15 shown in FIGS. 8 through 10, first four through-holes 20*b* are formed around the center of base plate 20 and second eight through-holes 20*c* adjacent to the outer circumference of base plate 20. Each of screening pieces 21 is positioned with its top on the first through-hole and with its other corners on the second through-holes 20*c*. These through-holes may be replaced by grooves formed in the upper surface of base plate 20 to have a certain depth.

With embodiments of high-frequency heating device, the exciting opening of rotating disk 15 is formed in substantial cross shape in any examples but may be formed in any shape in such a way that it has plural portions extending radially from the center of rotating disk to the outer circumference thereof and crossed in the center thereof, for example.

What is claimed is:

1. A high-frequency heating device comprising:

a housing;

a heating chamber housed in said housing, said heating chamber having an opening therein;

a high-frequency generator;

means for transmitting high-frequency energy from said generator to said opening in said heating chamber;

a rotating disk guiding the energy mounted for rotation within said opening, said disk having a base plate made of a low dielectric loss material and a plurality of high-frequency screening pieces arranged on the base plate and defining high-frequency exciting slots between the screening pieces which extend radially from the central axis of the base plate to the outer circumference thereof so that a distribution of high frequency energy across said opening has a maximum value at a central axis of said opening and is supplied therethrough to said heating chamber;

means for spacing said screening pieces a predetermined distance from said base plate; and driving means for rotating said rotating disk.

2. A high-frequency heating device according to claim 1 wherein the opening is provided in a roof portion of said heating chamber, the rotating disk is arranged to substantially cover the opening, and the high-frequency energy transmitting means is arranged on the roof portion of the heating chamber and has a waveguide structure opposite to the opening.

3. A high-frequency heating device according to claim 2 wherein the hole is circular and the rotating disk is concentrically arranged in the circle of the circular hole.

4. A high-frequency heating device according to claim 1 wherein the exciting slot has a plurality of slits extending radially from the center axis to the outer circumference of the base plate and through which the upper surface of the base plate is exposed.

5. A high-frequency heating device according to claim 1 wherein the high-frequency screening pieces are fan-shaped metal plates arranged symmetrically around the center axis of the base plate and each of the slits is defined by the adjacent sides of the metal plates.

6. A high-frequency heating device according to claim 1 wherein the corners of the screening piece are separated from the upper surface of the base plate by more than 0.5 mm.

7. A hgh-frequency heating device according to claim 1 or 6 wherein said separating means comprises projections located between said screening pieces and base plate.

8. A high-frequency heating device according to claim 7 wherein the projections are integrally formed with the base plate.

9. A high-frequency heating device according to claim 1 or 6 wherein the base plate has a plurality of holes thereon and the screening plate is positioned on the base plate with a corner facing a hole.

10. A high-frequency heating device comprising:

a housing;

a heating chamber housed in said housing, said heating chamber having an opening therein;

a high-frequency generator;

means for transmitting high-frequency energy from said generator to said opening in said heating chamber;

a rotating disk guiding the energy mounted for rotation within said opening, said disk having a base plate made of a low dielectric loss material and a plurality of high-frequency screening pieces arranged on the base plate and defining high-frequency exciting slots between the screening pieces which extend radially from the central axis of the base plate to the outer circumference thereof so that a distribution of high frequency energy across said opening has a maximum value at a central axis of said opening and is supplied therethrough to said heating chamber;

means for preventing a portion of the screening pieces from being excessively heated for the high-frequency energy; and driving means for rotating said rotating disk.

* * * * *